US009078509B1

(12) United States Patent
Thornton et al.

(10) Patent No.: US 9,078,509 B1
(45) Date of Patent: Jul. 14, 2015

(54) HAND CARRIED TRANSPORT ASSEMBLY

(71) Applicants: Andrew Thornton, Surrey (GB); Oliver Breit, Hong Kong (CN)

(72) Inventors: Andrew Thornton, Surrey (GB); Oliver Breit, Hong Kong (CN)

(73) Assignee: ZAK DESIGNS, INC., Spokane, WA (US)

( * ) Notice: Subject to any disclaimer, the term of this patent is extended or adjusted under 35 U.S.C. 154(b) by 70 days.

(21) Appl. No.: 14/140,873

(22) Filed: Dec. 26, 2013

(51) Int. Cl.
*A45F 5/00* (2006.01)
*A45F 5/10* (2006.01)

(52) U.S. Cl.
CPC ..... *A45F 5/10* (2013.01); *A45F 2005/1006* (2013.01)

(58) Field of Classification Search
CPC . A45F 5/1026; A45F 2005/1073; A45F 5/10; A45F 2005/1006; B65D 85/324; B65D 1/165; B65D 25/32; A47J 36/06; A47G 19/02
See application file for complete search history.

(56) References Cited

U.S. PATENT DOCUMENTS

| | | | | |
|---|---|---|---|---|
| 4,256,243 | A * | 3/1981 | Bianchi et al. | 224/244 |
| 4,478,348 | A * | 10/1984 | Cook | 220/318 |
| 4,505,506 | A | 3/1985 | Picozza | |
| 5,676,252 | A | 10/1997 | Lillelund et al. | |
| 6,361,746 | B1 | 3/2002 | Wlodarski | |
| 6,789,683 | B1 * | 9/2004 | Fisher | 210/465 |
| 6,832,390 | B1 * | 12/2004 | Kleinert et al. | 2/22 |
| 8,162,171 | B2 * | 4/2012 | Seehoff et al. | 220/757 |
| 2009/0166239 | A1 | 7/2009 | Seehoff et al. | |

OTHER PUBLICATIONS

PCT Search Report dated Oct. 28, 2014.

* cited by examiner

*Primary Examiner* — Stephen Vu
(74) *Attorney, Agent, or Firm* — Paine Hamblen, LLP

(57) ABSTRACT

A hand carried transport assembly is described and which includes a carriage that has a supporting base and a handle removably attached thereto; a transporting vessel that defines an internal cavity, and which releasably mates with the supporting base portion; and a product receiving insert for accepting products and which is sized so as to substantially nest within the internal cavity of the transporting vessel.

20 Claims, 12 Drawing Sheets

HAND CARRIED TRANSPORT ASSEMBLY

TECHNICAL FIELD

The present invention relates to a hand carried transport assembly, and more particularly to a carriage that includes a supporting base, a handle affixed to the base where the handle may be grasped by a user, a transporting vessel defining an internal cavity, and a product receiving insert for releasable mating receipt within the internal cavity.

BACKGROUND OF THE INVENTION

Various containers, trays and baskets have been designed through the years for carrying and storing food product containers. Designers of such products have attempted to create transportable containers which are, in one aspect, aesthetically appealing, and in another aspect, can provide a convenient means for carrying various food stuffs in bottles, jars, tubes, packages and like. Wire and wicker baskets, trays, boxes and the like are routinely encountered in lunch rooms, and on tables in homes and restaurants.

While the available products have operated with varying degrees of success, shortcomings attributable to their design have detracted from their usefulness. One such defect relates to the complexity of the overall design and the concomitant inability for a user to adequately clean the product. Often such products cannot be easily disassembled for cleaning. For example, many available products have cracks, crevices contours and other features which too readily harbor bacteria and particulates. Further, such products have not generally had the ability to secure the products being transported from inadvertently moving about while being transported. This has resulted in spilling of the products, or even breakage of containers enclosing such products.

Therefore, a hand carried transport assembly which addresses the shortcomings attendant with the prior art practices, and designs employed heretofore is the subject matter of the present invention.

SUMMARY OF THE INVENTION

According to a first aspect of the invention, a hand carried transport assembly includes a carriage that has a supporting base portion and a handle affixed thereto. The handle may be grasped by a user and carried. The transport assembly also includes a transporting vessel that defines an internal cavity. The vessel releasably mates with the supporting base portion. The transport assembly also includes a product receiving insert for use with the transporting vessel.

According to another aspect of the invention, the supporting base portion of the carriage includes an elongated main body with opposite first and second ends, and an intermediate portion that mates with a portion or end of the handle.

According to another aspect of the invention, the elongated main body includes a longitudinal axis, a peripheral edge, a top surface, and a bottom surface. The bottom surface mounts a non-slip surface which aids in the use of the invention.

According to another aspect of the invention, a portion of the handle is resiliently deformable, and shaped so as to conformably mate with the transporting vessel.

According to yet another aspect of the invention, a resilient substantially non-slip surface may be mounted on both the top surface of the elongated main body, and the distal end of the handle. The non-slip surface is operable to frictionally engage the transporting vessel so as to releasably retain the transporting vessel on the elongated main body.

According to another aspect of the invention, the transporting vessel includes a continuous sidewall which defines a top peripheral edge. The supporting base portion mounts a transversely disposed rib which releasably and forcibly engages the top peripheral edge of the transporting vessel so as to releasably secure the transporting vessel on the supporting base portion of the carriage.

According to another aspect of the invention, the product receiving insert is sized so as to substantially nest within the internal cavity of the transporting vessel.

According to another aspect of the invention, the product receiving insert comprises one or more product receiving inserts which are sized so as to matingly nest within the internal cavity of the transporting vessel. The one or more product receiving inserts may or may not fill the internal cavity of the transporting vessel.

According to yet another aspect of the invention, a removable cover releasably cooperates with a top peripheral edge of the transporting vessel. The removable cover may partially, substantially or completely occlude the internal cavity of the transporting vessel. The removable cover may be partially or substantially liquid or air tight.

Another aspect of the present invention relates to a transporting vessel which has an interior facing surface with a given shape, and wherein individual tabs are mounted on the inside facing surface and respectively extend laterally inwardly into the internal cavity of the transporting vessel, and wherein the product receiving insert has a recessed region formed therein, and which matingly cooperates with the respective tabs so as to reliably secure the product receiving insert within the internal cavity of the transporting vessel.

These and other aspects are described in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the Constitutional purposes of the U.S. Patent laws "to promote the progress of science in the useful arts" [Article I, Section 8].

Figure 1:
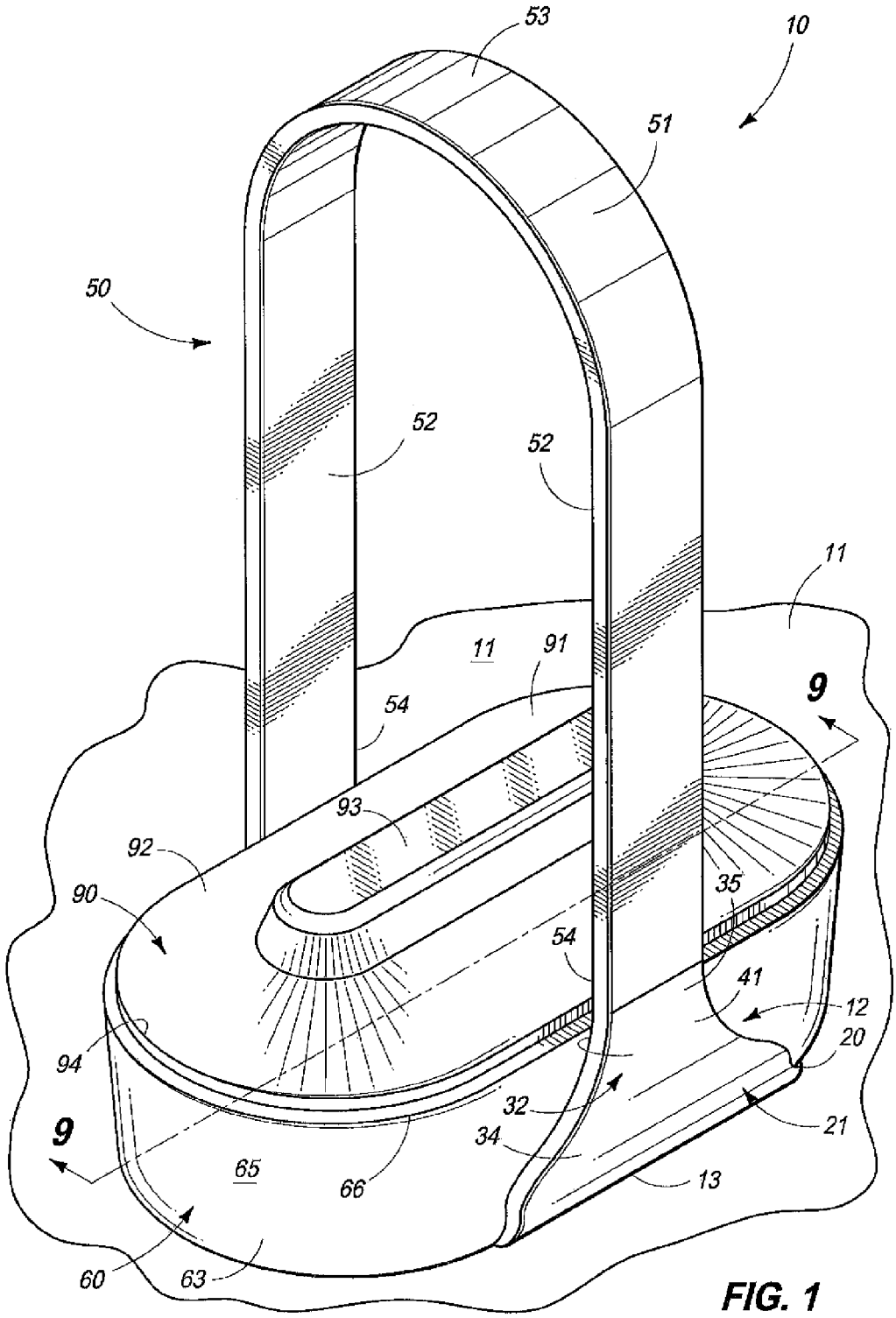
FIG. 1 is a perspective view of a hand carried transport assembly according to a first embodiment of the present invention.
Figure 2:
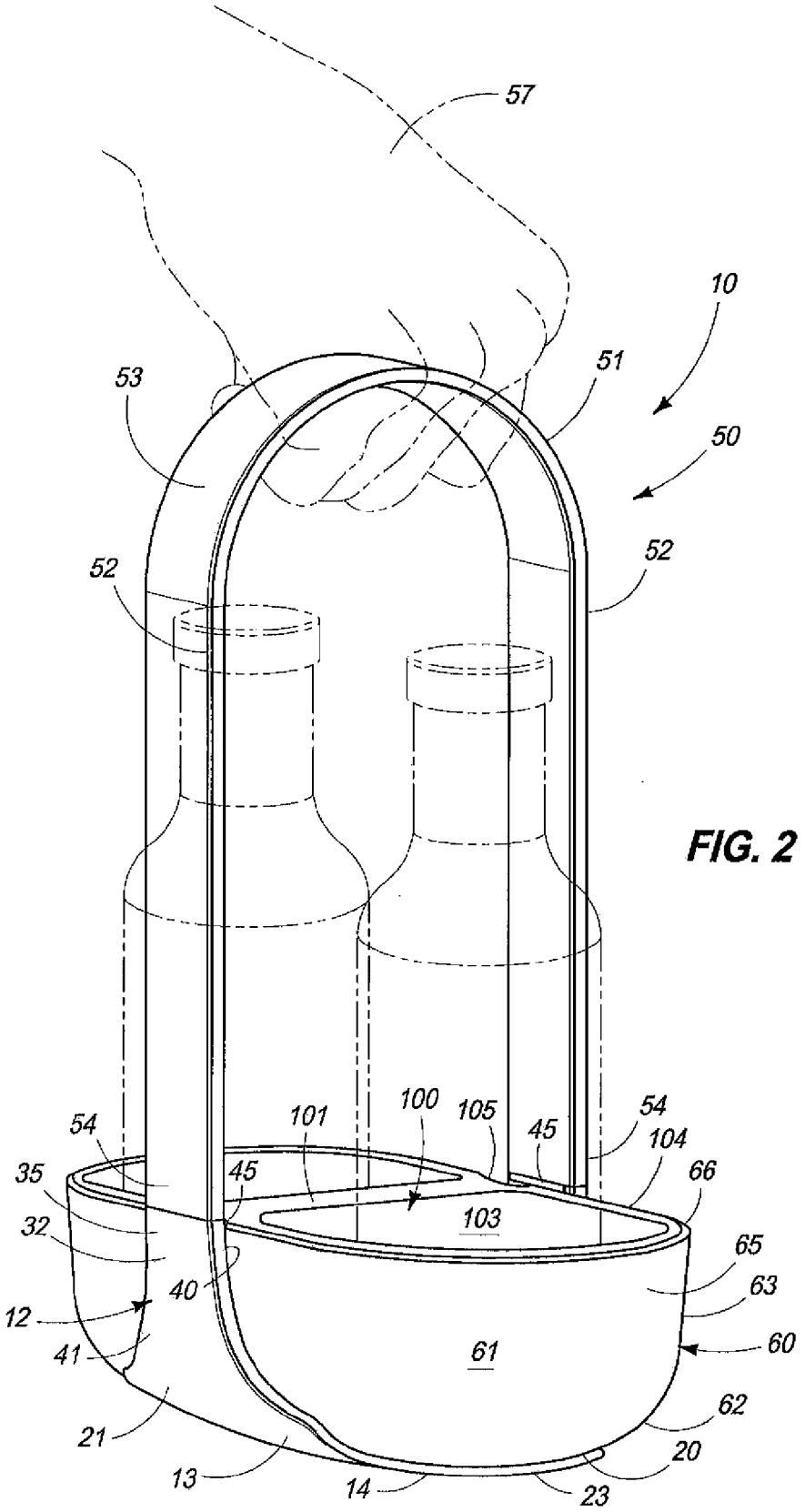
FIG. 2 is a second, perspective view of a hand carried transport assembly according to a second embodiment of the present invention.
Figure 3:
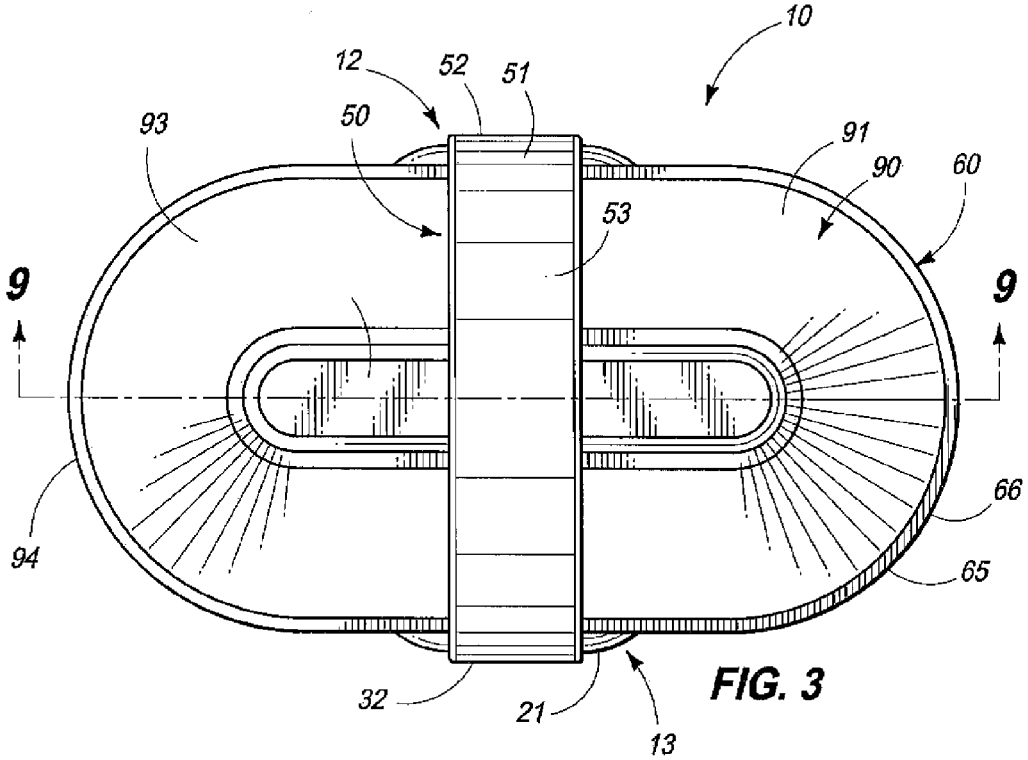
FIG. 3 is a top, plan view of the hand carried transport assembly as shown in FIG. 1.
Figure 4:
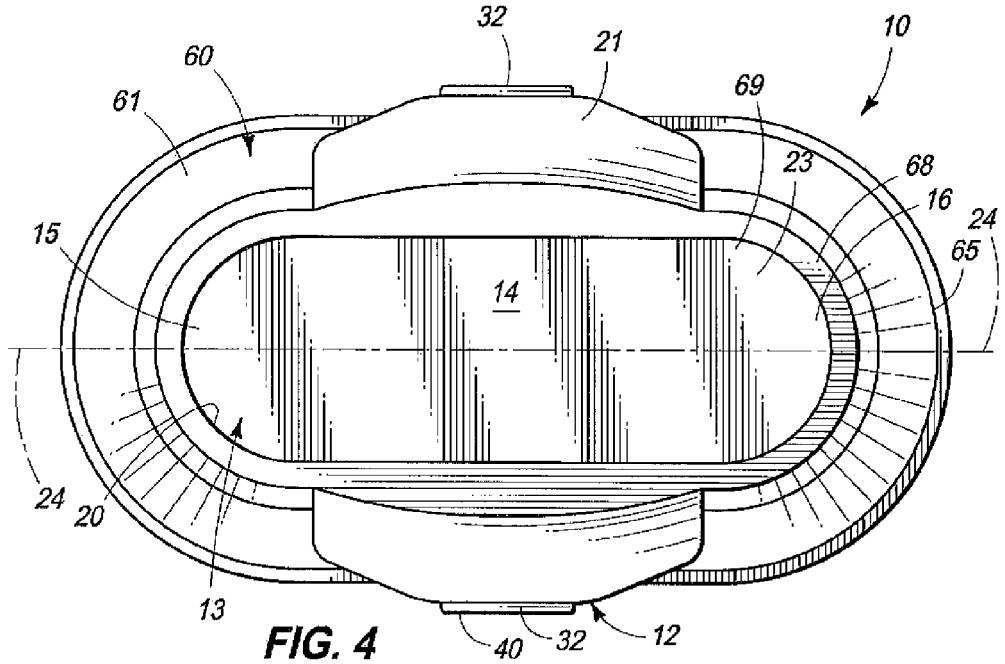
FIG. 4 is a bottom, plan view of the hand carried transport assembly as shown in FIG. 1.

The present invention, relates to a food product carrying device 10 having a handle, and which is best understood by a study of FIG. 1 and following. As seen in FIG. 2, the present invention 10 may be carried by a user, or further can be oriented in rested relation on an underlying supporting surface, which is generally indicated by the numeral 11 (FIG. 1). The invention 10 includes a carriage, which is generally indicated by the numeral 12. The carriage 12 is defined, in part, by a supporting base portion 13. The supporting base portion 13 has an elongated main body 14 (FIG. 2), which has a first end 15 and an opposite second end 16 (FIG. 4). The main body is also defined by a pair of oppositely disposed peripheral edges 20. The main body 14 also includes an intermediate portion or region 21, which is located approximately midway between the first and second ends 15 and 16, respectively. The main body 14 also includes a top surface 22 (FIG. 12), and an opposite bottom surface 23. The main body is also defined by a longitudinal axis which is generally indicated by the line labelled 24 (FIG. 4).

Figure 12:
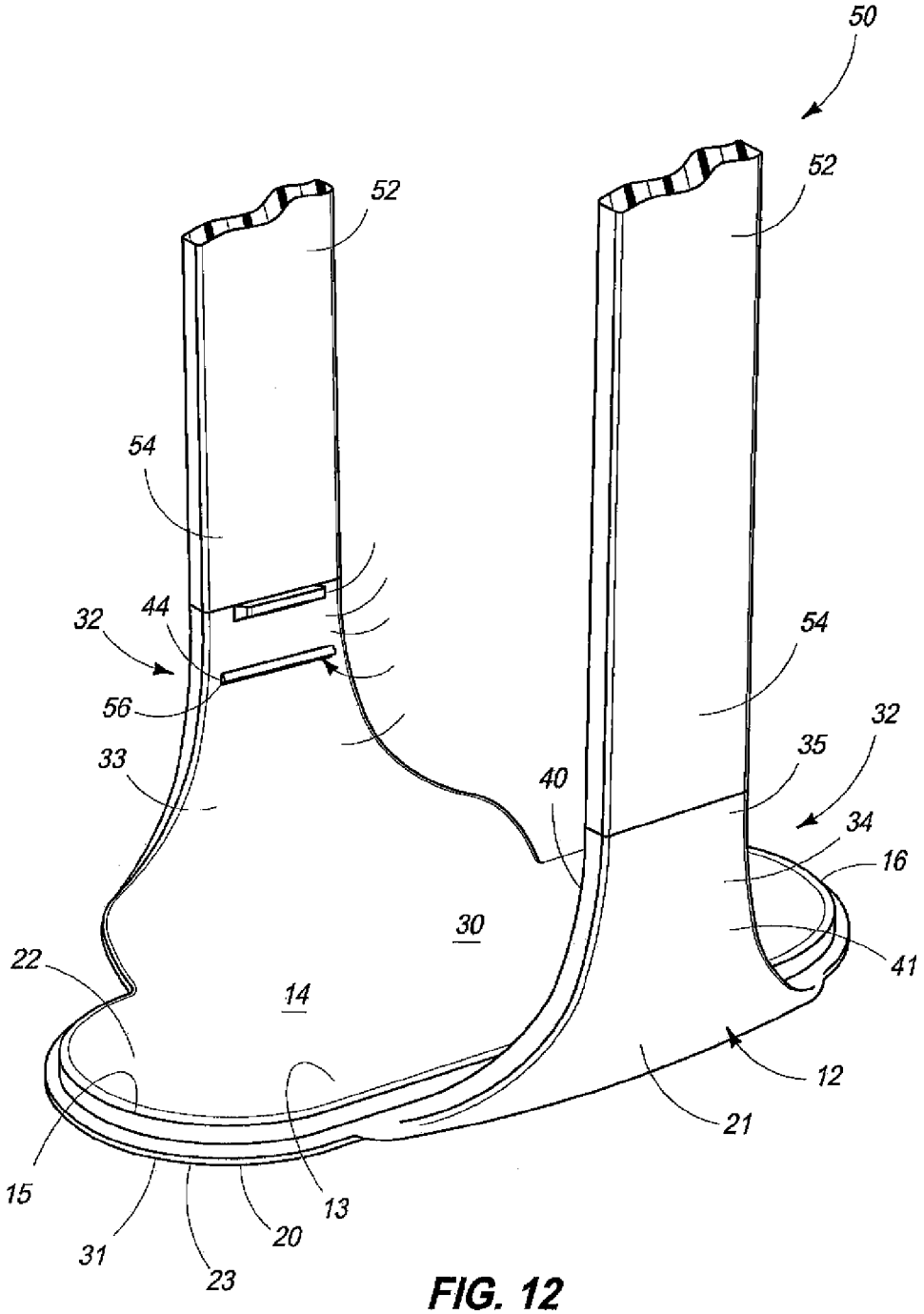
FIG. 12 is a partial, perspective view of a carriage which forms a feature of the hand carried transport assembly of the present invention.
Figure 13:
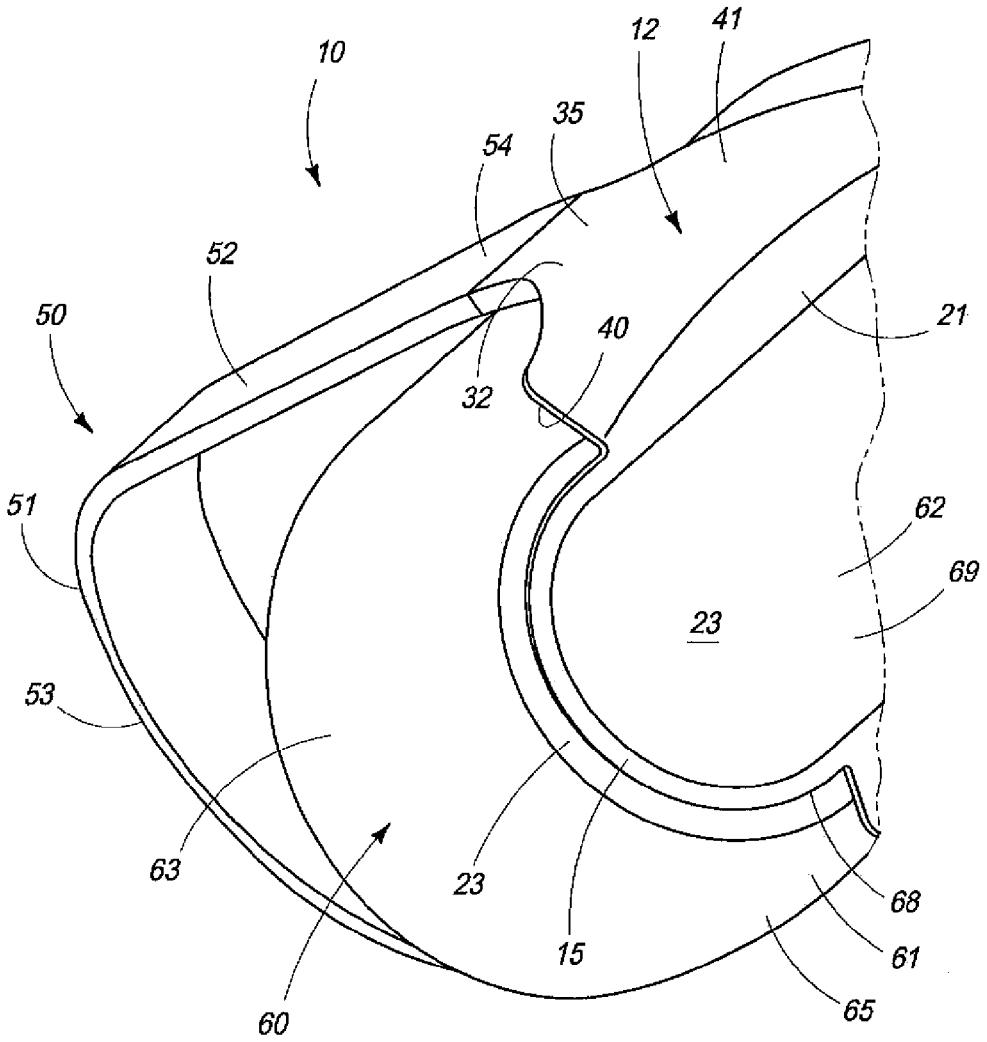
FIG. 13 is a fragmentary, bottom, perspective view of the hand carried transport assembly as shown in FIG. 1.
Figure 14B:
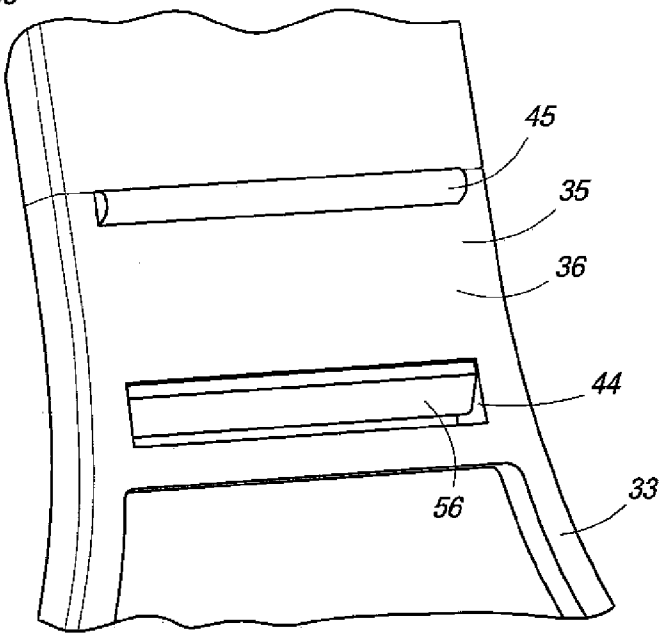
FIGS. 14A and 14B are greatly enlarged, side elevation views of a handle and base portion of a hand carried transport assembly according to a third embodiment of the present invention.

The present invention 10, and more specifically the main body 14 of the carriage 12, has a resilient substantially non-slip surface 30 and 31, respectively, which is mounted on the top and bottom surfaces 22 and 23, respectively (FIG. 12). The respective non-slip surfaces 30 and 31 are operable, on the one hand, to frictionally engage a transporting vessel, as will be discussed in greater detail, hereinafter, so as to releasably retain the transporting vessel on the elongated main body 14. Further, the non-slip surface 31 engages the surface 11. As will be seen in the drawings, the elongated main body 14 has a pair of spaced, elongated, peripheral edges 20 and further the main body 14 includes individual engagement portions 32, here shown as a first engagement portion 33, and a second engagement portion 34 (FIG. 12), and which individually extend upwardly relative to each of the spaced, elongated, peripheral edges forming the continuous peripheral edge 20 of the main body 14. Each of the first and second engagement portions 33 and 34, has a distal end 35. The distal end 35 has attached thereto, or is made integral therewith, a first or female portion 36 of a coupler (FIGS. 14A, 14B), the function of which will be discussed in greater detail in the paragraphs which follow.

Figure 14A:
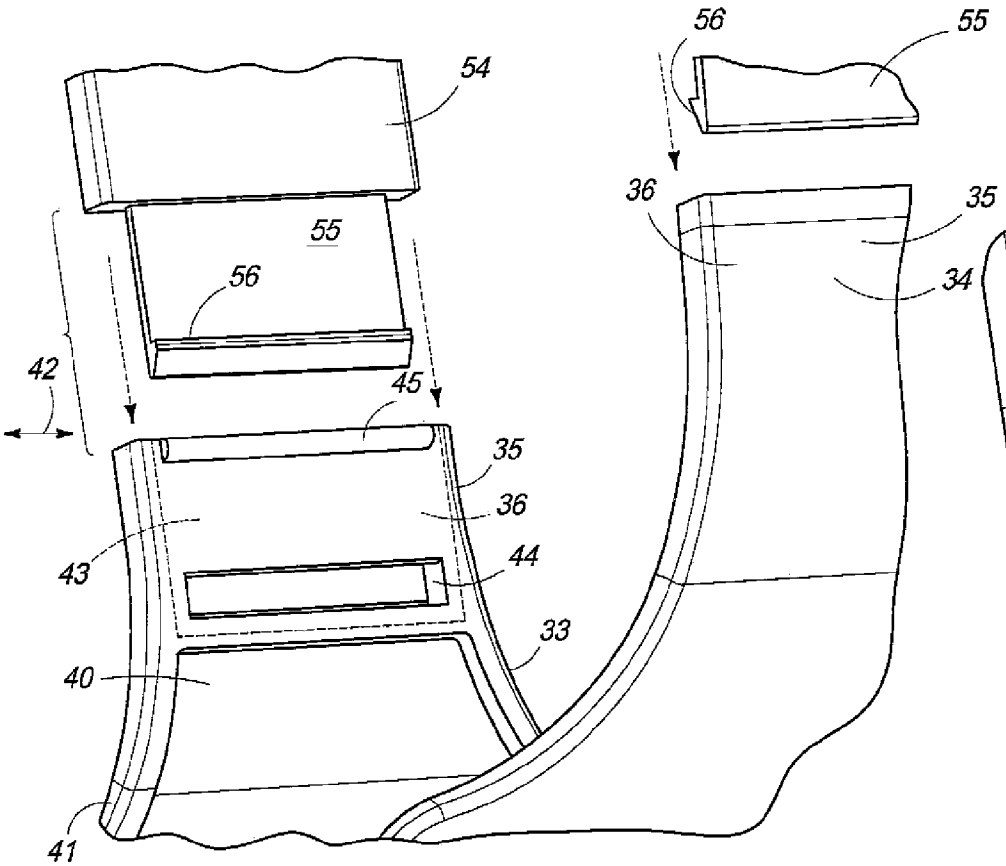

As seen in the drawings (FIG. 12), the first and second engagement portions 33 and 34 each have a curved inside-facing surface 40, which is shaped to substantially conformably mate with, and be juxtaposed relative to, a transporting vessel, and which will be discussed in greater detail below. Additionally, each of the individual engagement portions 32 has an outside facing surface 41, which is similarly curved, as will be recognized in FIG. 14A, for example. The respective engagement portions 32 are resiliently, transversely movable as indicated by the path of travel labelled 42 (FIG. 14A). Additionally, as seen in that view, the first portion of the coupler 36 is defined, at least in part, by an internal passageway 43, and which is shown in phantom lines. Additionally, an aperture 44 is formed in the inside-facing surface 40, and which couples with or is connected to, the internal passageway 43. Additionally, as will be seen in FIGS. 12 and 14A, and other views, a transversely disposed rib 45 is provided, and which is located on the curved inside-facing surface 40 of each of the respective engagement portions 32. The function of the transversely disposed rib 45 will be discussed in greater detail, below.

Figure 5A:
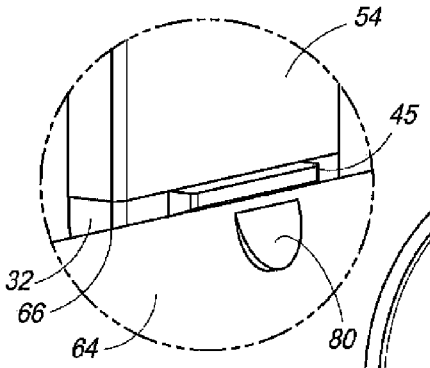
FIG. 5A is a partial, fragmentary, perspective view of a portion of FIG. 5.
Figure 5:
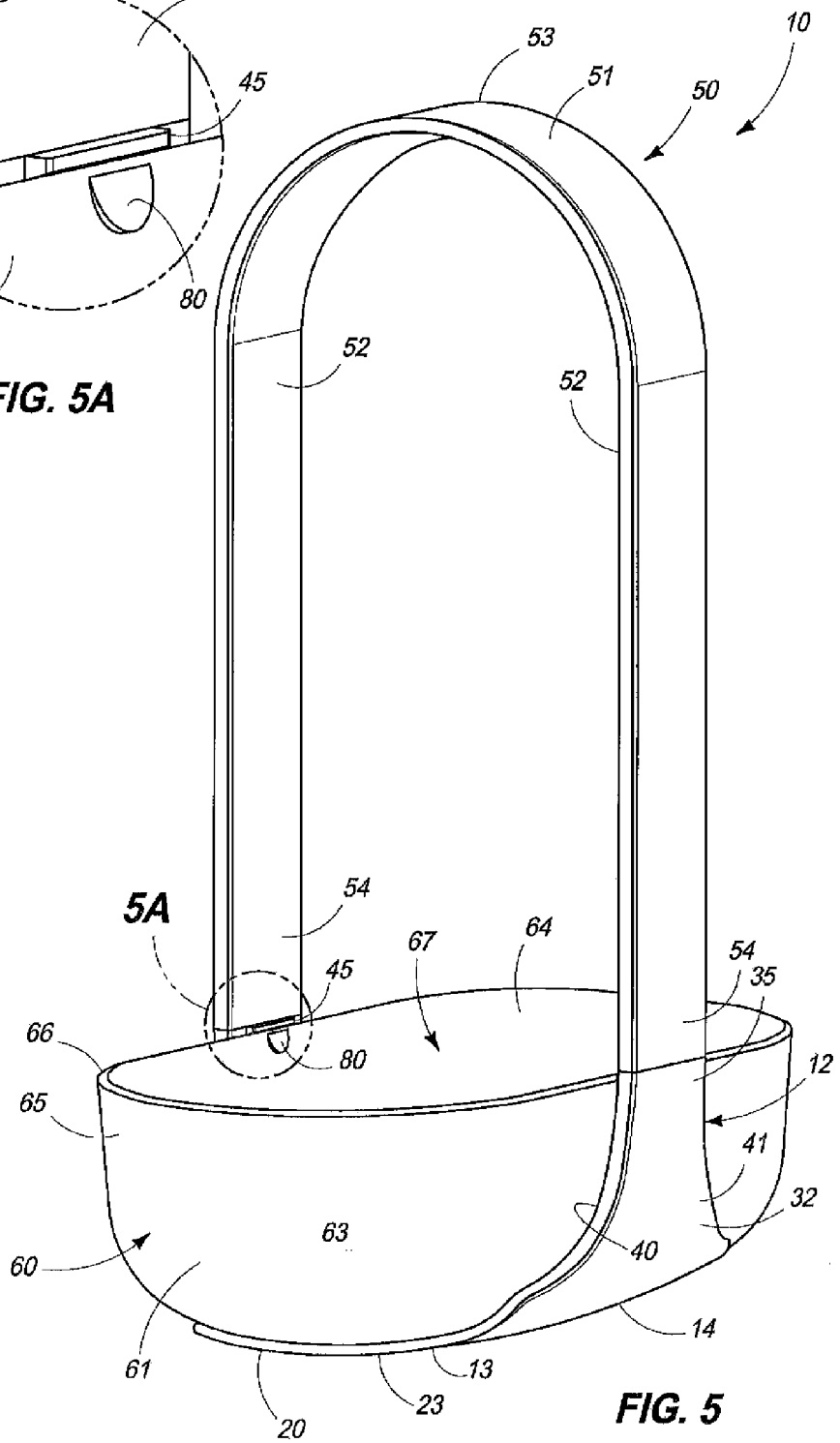
FIG. 5 is a perspective, fragmentary view of the hand carried transport assembly as shown in FIG. 1.
Figure 6:
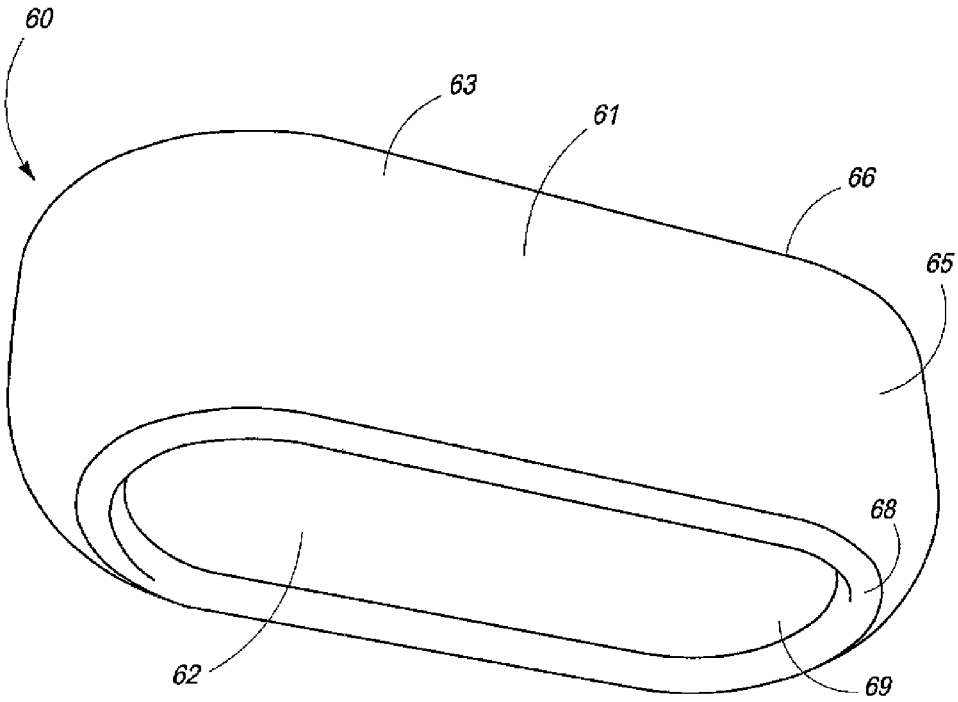
FIG. 6 is a bottom, perspective view of a transporting vessel which forms a feature of the present invention.
Figure 7:
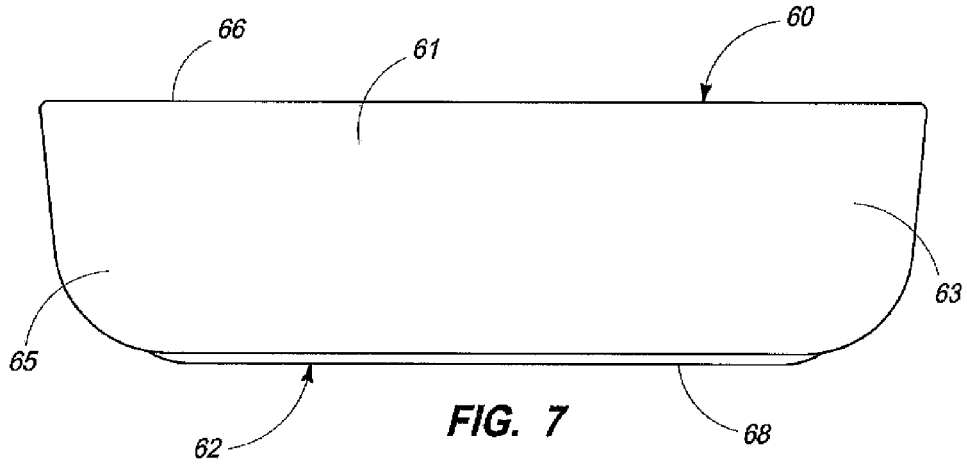
FIG. 7 is a side elevation view of a transporting vessel which forms a feature of the present invention.

The hand carried transport assembly 10 of the present invention further includes a handle, which is generally indicated by the numeral 50 (FIG. 5). The handle, as seen in the drawings, has a generally U-shape, and which is further defined by a main body 51. The main body 51 includes a pair of spaced arm members which are each labelled 52, respectively. The main body 51 has a proximal end 53, and a distal end 54. The distal end 54 of each of the respective spaced arm members 52, has made integral therewith a second or male portion of the coupler 55 (FIG. 14A), and which is operable to matingly cooperate with the first or female portion of the coupler 36, and which is made integral with the distal end 35 of each of the individual engagement portions 32. The second or male portion of the couple 55 includes an engagement member 56, which is sized so as to be telescopingly received through the internal passageway 43, and thereafter the engagement member 56 is received in coupling mating relation in the aperture 44 in the nature of a snap-fit. This is seen most clearly by reference to FIGS. 14A and 14B, respectively. Once received and seated within the internal passageway 43, the handle 50 cannot be readily disengaged from the supporting base portion 13 without damaging or destroying the respective individual engagement portions 32. The handle 51 may be grasped by a user whose hand is indicated by the numeral 57 in FIG. 2, and thereafter allows the hand carried transport assembly 10 to be readily moved between locations by a user.

Figure 8:
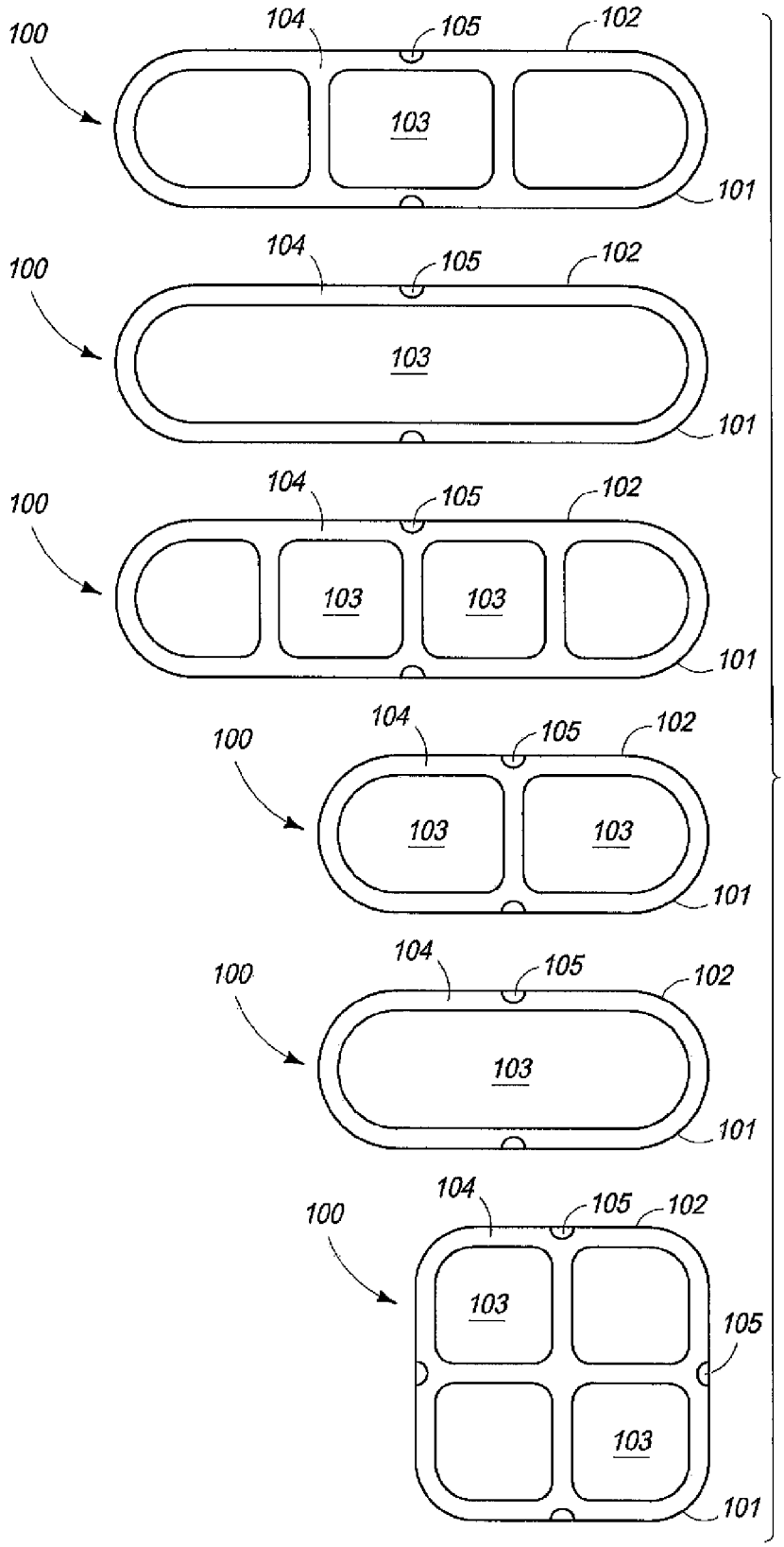
FIG. 8 is a top, plan view of a variety of variously shaped product receiving inserts which forms a feature of the present invention.
Figure 9:
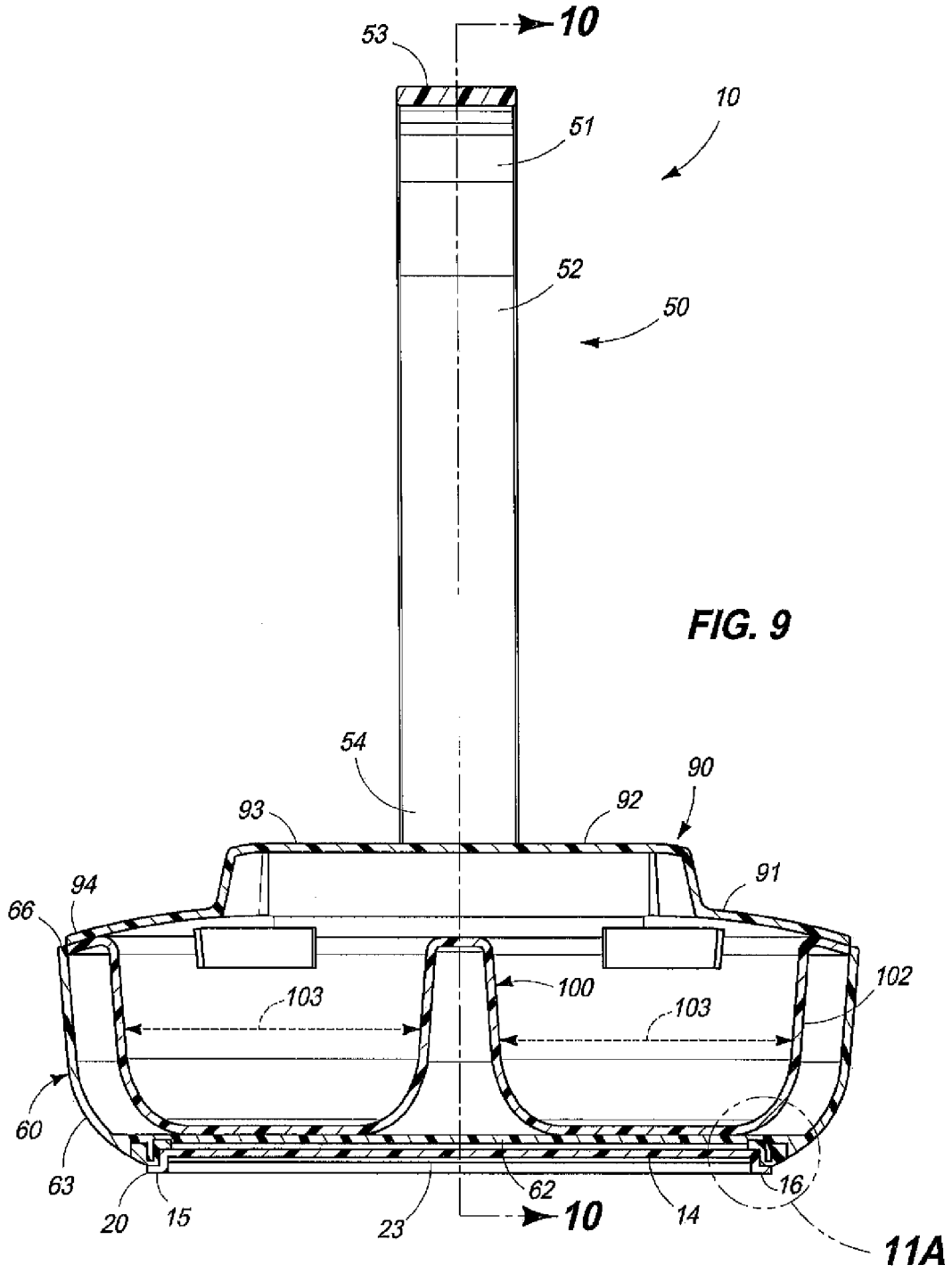
FIG. 9 is a transverse, vertical, cross-sectional view of the hand carried transport assembly, and which is taken from a position along line 9-9 of FIG. 1.
Figure 10:
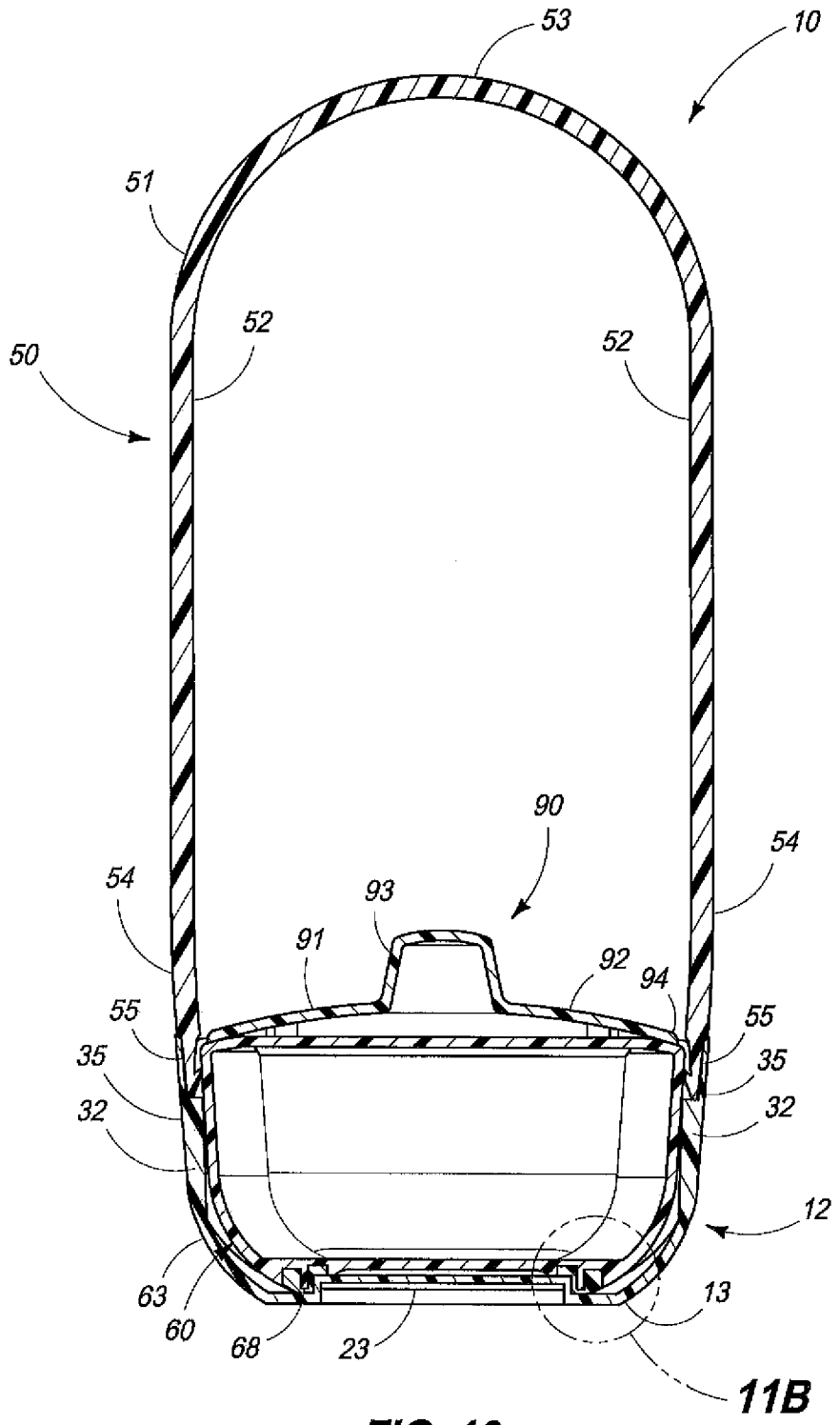
FIG. 10 is a second, vertical, cross-sectional view of the hand carried transport assembly as shown in FIG. 1, and which is further taken from a position along line 10-10 of FIG. 9.
Figure 11A:
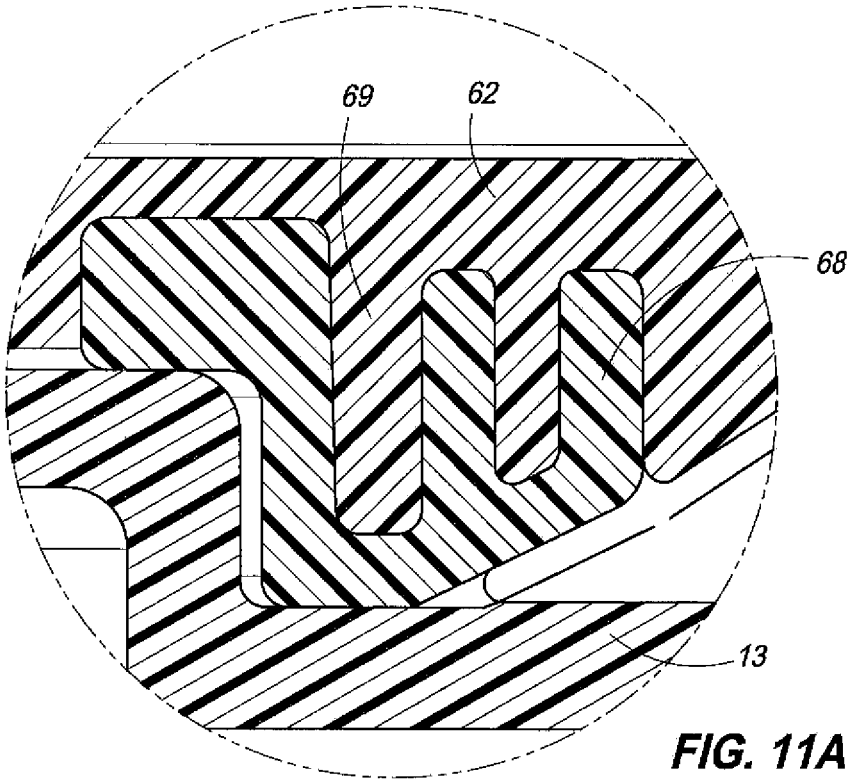
FIGS. 11A and 11B are fragmentary, greatly enlarged vertical sectional views, and which are taken at the locations as seen in FIGS. 9 and 10, respectively.
Figure 11B:
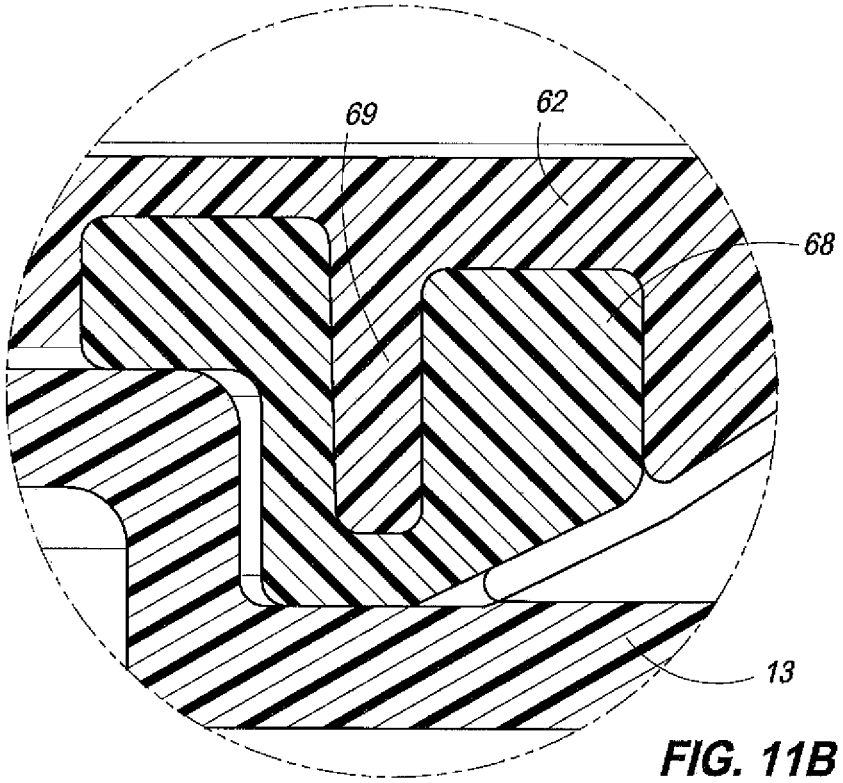

The hand carried transport assembly 10 of the present invention includes a transporting vessel which is generally indicated by the numeral 60, and which releasably cooperates with the supporting base portion 13, as earlier described, and which forms a portion of the carriage 12. The transporting, vessel has a main body 61. The main body 61 has a bottom surface 62. The bottom surface 62 has a predetermined surface area, and wherein the top surface 22 of the main body 14 of the supporting base portion 13, has a predetermined surface area which is substantially equal to or less than the predetermined surface area of the bottom surface 62 of the transporting vessel 60. Still further, the transporting vessel includes a circumscribing and generally vertically extending sidewall 63, which is made integral with the bottom surface 62. As seen in the drawings, the main body 61 is generally elongated, although other transporting vessel shapes 16 may further be employed with the carriage 12, as earlier described (FIG. 8). These other transporting vessels will be discussed in greater detail below. The main body 61, and in particular the circumscribing sidewall 63, has an inside-facing surface 64 and an outside-facing surface 65. Additionally, the circumscribing sidewall 63 has a top peripheral edge 66. In the arrangement as seen in the drawings, the distal end 35 of the respective engagement portions 32, each mount a transversely disposed rib 45, which releasably, and forcibly engages the top peripheral edge 66 of the transporting vessel 60, so as to releasably secure the transporting vessel 60 on the supporting base portion 13 of the carriage 12 (FIG. 5A). In order to secure the transporting vessel 60, it will be understood that the respective individual engagement portions 32 are resiliently, transversely moveable along the path of movement 42 (FIG. 14A), and thereby closely, releasably hold and releasably frictionally engage the outside-facing surface 65 of the circumscribing sidewall 63. Further, the inside-facing surface 64 of the circumscribing sidewall defines an internal cavity 67, having given dimensions. The internal cavity 67 is sized so as to matingly receive, in the nature of a nesting type arrangement, a product receiving insert, which will be discussed below. Additionally, as will be seen in the drawings, the transporting vessel 60 has a foot ring 68 which is formed on the bottom surface 62. Additionally, a resilient non-slip surface 69 is deposited or attached to the bottom surface 62. As should be understood, the resilient non-slip surface is mounted, at least in part, in covering relation relative to the bottom surface 62, and which is further operable to urge the transporting vessel 60 in an upward direction so as to resiliently removably connect the transporting vessel to the supporting base portion 13 by pressing the top peripheral edge 66 into releasable forcible engagement with the transversely disposed rib 45 (FIG. 5A). This interaction of the transversely disposed rib with the top peripheral edge 66 causes the main body 61 of the transporting vessel to be securely, yet releasably affixed to the carriage 12, thus allowing the transporting vessel 60 to be easily and conveniently transported by the handle 50. As will be recognized, the transporting vessel 60 has an exterior or outside-facing surface 65, having a given shape, and the individual engagement portions 32, have an inside-facing surface 64, which at least partially and matingly conforms to the shape of the exterior surface of the transport assembly 60. As will be appreciated from the drawings, the individual engagement portions 32 are resiliently deformable in a generally transverse direction which is generally laterally inwardly or outwardly relative to the respective spaced, elongated, peripheral edges 20 of the main body 14, of the supporting base portion 13 (FIG. 14A).

The transporting vessel 60 may further be provided with a given exterior color, which contrasts with the color of the non-slip foot ring so as to provide an aesthetically appealing exterior appearance for the hand carried transport assembly 10.

Referring now to FIGS. 5 and 5A, respectively, it will be seen that the transporting vessel 60, as described above, further includes a tab 80, which is mounted on the inside-facing surface 64 of the main body 61, and which further extends laterally inwardly into the internal cavity 65 of the transporting vessel 60. The product receiving insert, as will be discussed below, is operable to be matingly engaged by this tab 80 in the manner which will be discussed. As seen in the drawings, the hand carried transport assembly 10 further includes a removable cover 90, as indicated in the drawings. The cover is of traditional design, and has a main body 91, which may be formed of either a transparent, or opaque moldable substrate. The main body 91 has a top surface 92, and a gripping portion or region 93 is formed substantially centrally thereof, and which may be forcibly engaged by the fingers of a user in order to remove the cover 90 from its occluding engagement with the transporting vessel 60. The cover has a peripheral edge 94, which rests in engagement with the top peripheral edge 66 of the transporting vessel 60.

With reference to FIG. 8, the hand carried transport assembly 10 of the present invention includes a product receiving insert 100, which is operable to be matingly and releasably received within the internal cavity 67 of the transporting vessel 60. In this regard, the product receiving insert 100 is sized so as to substantially, completely matingly nest within the internal cavity of the transporting vessel 60. As seen in the drawings, the product receiving insert may comprise multiple product receiving inserts, which are sized so as to substantially matingly nest within the internal cavity 67 of the vessel 60, and which further may include multiple cavities within the product receiving insert 100. In this regard, the product receiving insert 100 has a main body 101, which is sized so as to matingly nest within the internal cavity 67 of the transporting vessel 60. In this regard, the main body 101 is defined by a peripheral sidewall 102. The sidewall 102 additionally defines an internal cavity 103. The internal cavity 103 may include multiple internal cavities as seen in the drawings (FIG. 8). Still further, the peripheral sidewall has a top peripheral edge 104. As seen in FIG. 8, for example, a recess region 105 is formed in the top peripheral edge 104. The recessed region 105 is conformably shaped so as to matingly engage, and receive the tab 80, as seen in FIG. 5A. Therefore, as the product receiving insert 100 is received within the internal cavity 67 of the main body 61, tab 80 moves into mating receipt within the recessed region 105, thereby securely locating the product receiving inserts 100 in nested mating relation within the internal cavity 67. The resilient sidewalls of the product transporting vessel 60 allow tab 80 to be readily moved out of engagement with the recessed region 105, thereby permitting the product receiving insert(s) 100 to be easily removed from the transporting vessel 60 for cleaning, replacement, or use with other product receiving inserts. As will be recognized by a study of the drawings, the product receiving inserts 100 may be in a variety of different shapes and sizes to accommodate the transport of many different products such as containers, as seen in FIG. 2, or various food products, not shown.

OPERATION

The operation of the described embodiment of the present invention is believed to be readily apparent is briefly summarized at this point.

In its broadest aspect, the present invention 10 relates to a hand carried transport assembly 10, which includes a carriage 12, having a supporting base portion 13, and further having a handle 50 which is affixed to the base portion 13, and which may be grasped by a user 57 and carried. The invention 10 further includes a transporting vessel 60, which defines an internal cavity 67, and which matingly and releasably cooperates with the supporting base portion 13. The invention 10 further includes, in its broadest aspect, a product receiving insert 100, which is operable to be matingly and releasably received within the internal cavity of the transporting vessel 60.

The supporting base portion 13 of the carriage 12 has an elongated main body 14, with opposite first and second ends 15 and 16, respectively, and an intermediate portion 21. The handle 50 is affixed to the intermediate portion of the main body 14.

As seen in the drawings, the elongated main body 14 has a longitudinal axis 24 and a peripheral edge 20. The elongated main body has a top surface 22, and a bottom surface 23, which engages an underlying supporting surface 11 when it is supported thereon. The handle 50 has a proximal end 53, and a distal end 54, which is made integral with the peripheral edge 20 of the main body 14 of the carriage 12. The distal end 54 of the handle 50 is resiliently deformable and shaped so as to conformably mate with the transporting vessel 60. In the arrangement as seen in the drawings, a resilient, substantially non-slip surface 30 is mounted on both the top surface 22 of the elongated main body 14, and the distal end 54 of the handle 50. The non-slip surface is operable to releasably frictionally, engage the transporting vessel 60, so as to releasably retain the transporting vessel 60 on the elongated main body 14. As will be further recognized from the drawings, the transporting vessel 60 has a bottom surface 62, having a predetermined surface area. The top surface 22 of the elongated main body 14 of the supporting base portion 13 of the carriage 12 has a predetermined surface area, which is substantially equal to or less than the predetermined surface area of the bottom surface 62 of the transporting vessel 60.

The hand carried transport assembly 10 of the present invention, as earlier noted, includes the transporting vessel 60, which has a continuous sidewall 63, which defines a top peripheral edge 66. The distal end 35 of the individual engaging portions 32, mounts a transversely disposed rib 45, which releasably and forcibly engages the top peripheral edge 66 of the transporting vessel 60, so as to releasably secure the transporting vessel 60 on the supporting base portion 13 of the carriage 12. As seen in the drawings, the product receiving insert 100 is sized so as to substantially, matingly nest within the internal cavity 67 of the transporting vessel 60. Further, the product receiving insert may comprise multiple product receiving inserts 100 as seen in FIG. 8, and which are sized so as to substantially matingly nest within the internal cavity 67 of the transporting vessel 60. Additionally, as seen in the drawings, a removable cover 90 is provided, and which releasably cooperates with the top peripheral edge 66 of the transporting vessel 60, and which further substantially occludes the internal cavity 67 of the transporting vessel 60. As depicted, the main body 14 of the supporting base portion 13 has a pair of spaced, elongated peripheral edges 20. The main body 14 further has individual engagement portions 32 which extend upwardly relative to each of the spaced elongated peripheral edges 20. Each engagement portion 32 has a first portion of a coupling 36, which is made integral with the distal end 35 thereof. In the drawings it will be recognized that the handle 50 is U-shaped and is further defined by two spaced arm members 52. Each arm member, at the distal end 54, of the handle 50, has a second portion of a coupler 55, which matingly cooperates with the first portion of the coupler 36, so as to join the distal end 54 of the handle 50 to the respective individual engagement portions 32. As earlier noted, the first and second couplers 36 and 55, respectively, cannot be readily or conveniently disengaged from each other after the first portion of the coupler 36 engages the second portion of the coupler 55.

The present invention 10 further includes a resilient non-slip surface 69, which is mounted, at least in part, in covering relation relative to the bottom surface 62 of the transporting vessel 60. This non-slip surface is operable to urge the transporting vessel 60 in an upward direction so as to releasably and resiliently couple the transporting vessel to the supporting base portion 13. In the arrangement as seen in the drawings, the transporting vessel 60 has an exterior facing surface having a given shape. The individual engagement portions 32 as provided have an overall exterior shape 64, which at least partially, and matingly conforms to the shape of the exterior surface 65 of the transport vessel 60. In the arrangement, as illustrated, the individual engagement portions 32 are resiliently deformable in a generally transverse direction 42, which is laterally, inwardly or outwardly relative to the respective spaced elongated peripheral edges 20 of the main body 14 of the supporting base portion 13. The individual engagement portions releasably, frictionally engage the exterior facing surface 65 of the transporting vessel 60. The present invention 10 as shown in the drawings also includes a transporting vessel 60, which has an interior facing surface 64 with a given shape. As seen in the drawings a tab 80 is mounted on the inside-facing surface 64, and extends laterally into the internal cavity 67 of the transporting vessel 60. The product receiving insert 100 has a recessed region 105 formed therein and which matingly cooperates with the tab 80 so as to releasably secure the product receiving insert 100 within the internal cavity 65 of the transporting vessel 60.

Therefore, it will be seen that the hand carried transport assembly of the present invention provides convenience and a means for transporting objects of interest in a manner not possible heretofore. The present device is flexible in its overall configuration, and provides a ready means for a user to substitute and employ variously designed product receiving inserts 100 to receive and transport various food products or other containers as illustrated.

In accordance with the statute, the invention has been described in language more or less specific as to structural and methodical features. It is to be understood, however, that the invention is not limited to the specific features shown and described since the means herein disclosed comprise preferred forms of bringing the invention into effect. The invention is, therefore, claimed in any of its forms or modifications within the proper scope of the appended claims appropriately interpreted in accordance with the Doctrine of Equivalence.

We claim:

1. A hand carried transport assembly comprising:

a carriage, having a supporting base portion, and further having a handle affixed to the base portion, and which may be grasped by a user and carried;

a transporting vessel defining an internal cavity, and which matingly, and releasably cooperates with the supporting base portion;

a product receiving insert which is operable to be matingly, and releasably received within the internal cavity of the transporting vessel; wherein the supporting base portion of the carriage has an elongated main body with opposite first and second ends, and an intermediate portion, and wherein the handle is affixed to the intermediate portion of the main body, and wherein the supporting base portion further includes individual engaging portions which are made integral with the intermediate portion, and wherein the elongated main body has a longitudinal axis, and a peripheral edge, and wherein the elongated main body has a top surface, and a bottom surface which engages an underlying supporting surface, and wherein the handle has a proximal end, and a distal end which is made integral with the peripheral edge of the main body of the carriage, and wherein the distal end of the handle is resiliently deformable, and shaped so as to conformably mate with the transporting vessel; and a resilient substantially non-slip surface mounted on both of the to surface of the elongated main body, and the distal end of the handle, and which is operable to frictionally engage the transporting vessel so as to releasably retain the transporting vessel on the elongated main body and wherein the transporting vessel has a bottom surface having a predetermined surface area, and wherein the top surface of the elongated main body of the supporting base portion of the carriage has a predetermined surface area which is substantially equal to, or less than, the predetermined surface area of the bottom surface of the transporting vessel.

2. The hand carried transport assembly as claimed in claim 1, and wherein the transporting vessel has a continuous sidewall which defines a top peripheral edge, and wherein the individual engaging portions mounts a transversely disposed rib which releasably, and forcibly engages the top peripheral edge of the transporting vessel, so as to releasably secure the transporting vessel on the supporting base portion of the carriage.

3. The hand carried transport assembly as claimed in claim 2, and wherein the product receiving insert is sized so as to substantially matingly nest within the internal cavity of the transporting vessel.

4. The hand carried transport assembly as claimed in claim 3, and wherein the product receiving insert comprises multiple product receiving inserts which are sized so as to substantially matingly nest within the internal cavity of the transporting vessel.

5. The hand carried transport assembly as claimed in claim 2, and further comprising a removable cover which releasably cooperates with the top peripheral edge of the transporting vessel, and which further substantially occludes the internal cavity of the transporting vessel.

6. The hand carried transport assembly as claimed in claim 5, and wherein the main body of the supporting base portion has a pair of spaced, elongated peripheral edges, and wherein the individual engagement portions extend upwardly relative to each of the spaced, elongated peripheral edges, and wherein the individual engagement portions each have a distal end, and wherein the distal end of each engagement portion further has a first portion of a coupler.

7. The hand carried transport assembly as claimed in claim 6, and wherein the handle is U-shaped, and is further defined by two, spaced arm members, and wherein each arm member at the distal end of the handle has a second portion of a coupler which matingly cooperates with the first portion of the coupler so as to join the distal end of the handle to the respective individual engagement portions.

8. The hand carried transport assembly as claimed in claim 7, and wherein the first and second coupler cannot be readily disengaged from each other after the first portion of the coupler engages the second portion of the coupler.

9. The hand carried transport assembly as claimed in claim 8, and wherein a resilient, non-slip surface is mounted, at least in part, in covering relation relative to the bottom surface of the transporting vessel, and which is further operable to urge the transporting vessel in an upward direction so as to resiliently removably connect the transporting vessel to the supporting base portion.

10. The hand carried transport assembly as claimed in claim 9, and wherein the transporting vessel has an exterior facing surface having a given shape, and wherein the individual engagement portions have an exterior shape which at least partially, and matingly conform to the shape of the exterior surface of the transport assembly.

11. The hand carried transport assembly as claimed in claim 10, and wherein the individual engagement portions are resiliently deformable in a direction which is laterally inwardly or outwardly relative to the respective spaced, elongated peripheral edges of the main body of the supporting base portion so to releasably frictionally engage the exterior facing surface of the transporting vessel.

12. The hand carried transport assembly as claimed in claim 11, and wherein the transporting vessel has an interior facing surface with a given shape, and wherein a tab is mounted on the inside facing surface and extends, laterally inwardly into the internal cavity of the transporting vessel, and wherein the product receiving insert has a recessed region formed therein which matingly cooperates with the tab so as to releasably secure the product receiving insert within the internal cavity of the transporting vessel.

13. A hand carried transport assembly comprising:

a supporting base portion having an elongated main body with opposite first and second ends, and an intermediate portion, and wherein the main body is defined by a pair of spaced, elongated peripheral edges, top and bottom facing surfaces, and opposite first and second ends, and an intermediate portion, and wherein the supporting base portion further has individual engagement portions which are made integral with the intermediate portion of the main body, and which further extend upwardly relative to the respective elongated peripheral edges of the elongated main body, and wherein the respective individual engagement portions each have a portion of a coupler which is made integral therewith, and wherein the respective individual engagement portions are resiliently deformable in a transverse direction relative to elongated main body of the supporting base portion;

a handle having a main body with a proximal and a distal end, and which is defined, at least in part, by a pair of spaced, depending arm members which converge at the proximal end of the main body, and wherein the pair of spaced arms, at the distal end of the handle, each have another coupler portion which matingly cooperates with the portion of the coupler which is made integral with the respective, individual engagement portions, and which further affixes the handle to the supporting base portion;

a transporting vessel having an elongated main body which has an internal facing surface which defines an internal cavity, and which further has a top peripheral edge, and an exterior facing surface, and wherein the respective individual engagement portions releasably, frictionally engage the exterior facing surface of the transporting vessel, and wherein the transporting vessel rests in a supported orientation on the supporting base portion, and is further located between the individual engagement portions; and a product receiving insert which is operable to be matingly and releasably received within the internal cavity of the transporting vessel.

14. The hand carried transport assembly as claimed in claim 13, and wherein the individual engagement portions are conformably shaped to matingly engage at least a portion of the exterior facing surface of the transporting vessel, and wherein the respective individual engagement portions further define a transversely disposed rib which matingly engages the top peripheral edge of the transporting vessel so as to releasably retain the transporting vessel on the supporting base portion.

15. The hand carried transport assembly as claimed in claim 14, and wherein a tab is made integral with the inside facing surface of the transporting vessel and is located adjacent to the top peripheral edge thereof, and wherein the product receiving insert has a top peripheral edge which has a recessed region formed therein, and which has a shape which matingly receives and cooperates with the tab and which releasably secures the product receiving insert within the internal cavity of the transporting vessel.

16. The hand carried transport assembly as claimed in claim 15, and wherein the elongated main body of the transporting vessel has a bottom surface which further defines a circumscribing foot ring, and wherein the bottom surface of the transporting vessel has a predetermined surface area, and wherein the elongated main body of the supporting base has a surface area which is equal to or less than the surface area of the bottom surface of the transporting vessel.

17. The hand carried transport assembly as claimed in claim 16, and wherein the top and bottom surface of the supporting base portion has a resilient non-slip surface applied thereto, and wherein the resilient, non-slip surface mounted on the top surface of the supporting base portion resiliently urges the transporting vessel upwardly into engagement with the transversely disposed rib to thereby releasably capture the transporting vessel in a secure orientation on the supporting base portion.

18. The hand carried transport assembly as claimed in claim 17, and wherein the product receiving insert includes multiple product receiving inserts which matingly nest within the internal cavity of the transporting vessel, and wherein the hand carried transport assembly further comprises a removable cover which releasably engages the top peripheral edge of the transporting vessel and which further substantially occludes the internal cavity thereof, and wherein the removable cover has a main body which is received, at least in part between, the pair of spaced, depending arms of the handle.

19. The hand carried transport assembly as claimed in claim 18, and further comprising a resilient, non-slip foot ring covering member, and which engages, and further substantially covers the foot ring, and wherein the exterior facing surface of the transporting vessel has a given color, and wherein the resilient, non-slip foot ring has a color which contrasts with the given color of the exterior facing surface of the transporting vessel.

20. The hand carried transport assembly as claimed in claim 19, and wherein the respective coupler portions are snap-fit couplers which cannot be readily separated after the coupling of the respective coupler portions together without destroying the respective coupler portions.

* * * * *